US010816216B2

(12) United States Patent
Baas et al.

(10) Patent No.: US 10,816,216 B2
(45) Date of Patent: Oct. 27, 2020

(54) METHOD AND APPARATUS FOR PREVENTING COOKTOP FIRES

(71) Applicant: Electrolux Home Products, Inc., Charlotte, NC (US)

(72) Inventors: Steven Baas, Springfield, TN (US); William Michael Pryor, Springfield, TN (US)

(73) Assignee: Electrolux Home Products, Inc., Charlotte, NC (US)

( * ) Notice: Subject to any disclaimer, the term of this patent is extended or adjusted under 35 U.S.C. 154(b) by 304 days.

(21) Appl. No.: 15/838,981

(22) Filed: Dec. 12, 2017

(65) Prior Publication Data

US 2019/0178501 A1 Jun. 13, 2019

(51) Int. Cl.

| | |
|---|---|
| ***F24C 7/08*** | (2006.01) |
| ***H05B 1/00*** | (2006.01) |
| ***H05B 1/02*** | (2006.01) |

(52) U.S. Cl.

CPC ..... *F24C 7/088* (2013.01); *F24C 7/082* (2013.01); *H05B 1/0213* (2013.01); *H05B 1/0266* (2013.01); *H05B 2213/04* (2013.01)

(58) Field of Classification Search

CPC ..... F24C 7/088; F24C 7/082; H05B 1/0213; H05B 1/0266; H05B 2213/04

See application file for complete search history.

(56) References Cited

U.S. PATENT DOCUMENTS

| | | | | | |
|---|---|---|---|---|---|
| 4,206,344 | A * | 6/1980 | Fischer | F24C 15/106 | 219/494 |
| 4,214,151 | A * | 7/1980 | Kicherer | F24C 15/106 | 219/492 |
| 4,788,415 | A * | 11/1988 | Whipple, Jr. | F24C 15/106 | 219/483 |
| 5,094,154 | A * | 3/1992 | Nopanen | A47J 37/0835 | 219/492 |
| 5,111,027 | A * | 5/1992 | Fowler | F24C 7/087 | 219/492 |

(Continued)

FOREIGN PATENT DOCUMENTS

| | | |
|---|---|---|
| GB | 1157483 | 7/1969 |
| GB | 2086676 | 5/1982 |
| WO | 2001064084 | 9/2001 |

*Primary Examiner* — Frederick C Nicolas

(74) *Attorney, Agent, or Firm* — Pearne & Gordon LLP

(57) ABSTRACT

A power circuit for controlling power to a heating element includes an electric resistive element and a thermal switch assembly in series. The thermal switch assembly includes a first contact connected to the electric resistive element, a second contact, and a bimetal element configured to electrically connect and disconnect the first and second contacts. The bimetal element establishing an electrical connection between the first and second contacts when a temperature of the bimetal element is below a predetermined cut-off temperature, and no longer electrically connecting the first and second contacts when the bimetal element is at or above the predetermined cut-off temperature. A first voltage is applied to the electric resistive element when the bimetal element electrically connects the first and second contacts and a second voltage, lower than the first voltage, is applied to the electric resistive element when the bimetal element electrically disconnects the first and second contacts.

14 Claims, 3 Drawing Sheets

(56) References Cited

U.S. PATENT DOCUMENTS

| | | | | |
|---|---|---|---|---|
| 5,293,028 | A * | 3/1994 | Payne | F24C 15/106 219/486 |
| 5,981,916 | A | 11/1999 | Griffiths et al. | |
| 6,365,988 | B1 | 4/2002 | Imer et al. | |
| 6,753,511 | B2 | 6/2004 | Mathews, Jr. et al. | |
| 6,933,474 | B2 * | 8/2005 | Shukla | H05B 1/0266 219/483 |
| 7,045,748 | B2 * | 5/2006 | Blackson | F24C 3/126 219/446.1 |
| 7,964,227 | B2 | 6/2011 | Su | |
| 8,803,048 | B2 | 8/2014 | Bassill et al. | |
| 10,251,214 | B2 * | 4/2019 | Gomez | H05B 1/0213 |
| 2016/0209045 | A1 | 7/2016 | Millius | |
| 2017/0027020 | A1 | 1/2017 | Gomez et al. | |

* cited by examiner

METHOD AND APPARATUS FOR PREVENTING COOKTOP FIRES

FIELD

The present invention relates generally to methods and apparatus for controlling a cooking appliance, and more particularly to methods and apparatus for controlling power to a heating element of a cooking appliance.

BACKGROUND

Typically, heating elements of cooking appliances can reach operating temperatures of several hundred degrees in order to cook foodstuff in cookware. With this comes some inherent risk of burns and fire. For example, if foodstuff within cookware reaches a high enough temperature, the foodstuff can auto-ignite. As another example, if a cookware containing boiling water is heated for too long, the water will boil dry, at which point the cookware temperature will rapidly increase to temperatures that can cause serious burns. It is desirable to prevent cookware and foodstuff, and especially cooking or food oils, from reaching such high temperatures.

SUMMARY

There is provided a power circuit for controlling power to a heating element of a cooking appliance. The power circuit including an electric resistive element. A thermal switch assembly is in series with the electric resistive element and includes a first contact connected to the electric resistive element, a second contact, and a bimetal element configured to electrically connect and disconnect the first and second contacts. The bimetal element establishing an electrical connection between the first contact and the second contact when a temperature of the bimetal element, as influenced by the electric resistive element, is below a predetermined cut-off temperature, and the bimetal element no longer electrically connecting the first contact and the second contact when the temperature of the bimetal element, as influenced by the electric resistive element, is at or above the predetermined cut-off temperature. A first voltage is applied to the electric resistive element when the bimetal element electrically connects the first contact and the second contact and a second voltage, lower than the first voltage, is applied to the electric resistive element when the bimetal element electrically disconnects the first contact and the second contact.

There is also provided a power circuit for controlling power to a heating element of a cooking appliance. The power circuit including an electric resistive element and a thermal switch assembly in series with the electric resistive element. The thermal switch assembly including a first contact connected to the electric resistive element, a second contact, a bimetal element configured to electrically connect and disconnect the first and second contacts based on its temperature, a bypass connected to the first contact and the second contact for bypassing the bimetal element, and a diode disposed in the bypass. The bimetal element establishing an electrical connection between the first contact and the second contact when a temperature of the bimetal element is below a predetermined cut-off temperature, and the bimetal element no longer electrically connecting the first contact and the second contact when the bimetal element is at or above the predetermined cut-off temperature.

There is further provided a power circuit for controlling power to a heating element of a cooking appliance. The power circuit includes an electric resistive element and a thermal switch assembly is in series with the electric resistive element. The thermal switch assembly includes a first contact connected to the electric resistive element, a second contact connected to a phase conductor at a first voltage, a third contact connected to a conductor at a second voltage lower than the first voltage, and a bimetal element configured to alternately connect and disconnect the first contact to and from each of the second contact and the third contact. The bimetal element establishing an electrical connection between the first contact and the second contact when a temperature of the bimetal element is below a predetermined cut-off temperature, and the bimetal element establishing an electrical connection between the first contact and the third contact when the bimetal element is at or above the predetermined cut-off temperature.

There is further provided a method for operating an electric heating element of a cooking appliance having a bimetal element in series with the electric heating element. The method including steps of supplying a voltage with a full-waveform power to the heating element when the bimetal element is below a predetermined cut-off temperature, and limiting the supplied voltage to a half-waveform power when the bimetal element is at or above said predetermined cut-off temperature.

BRIEF DESCRIPTION OF THE DRAWINGS

The foregoing and other aspects will become apparent to those skilled in the art to which the present examples relate upon reading the following description with reference to the accompanying drawings, in which.

DETAILED DESCRIPTION

Figure 1:
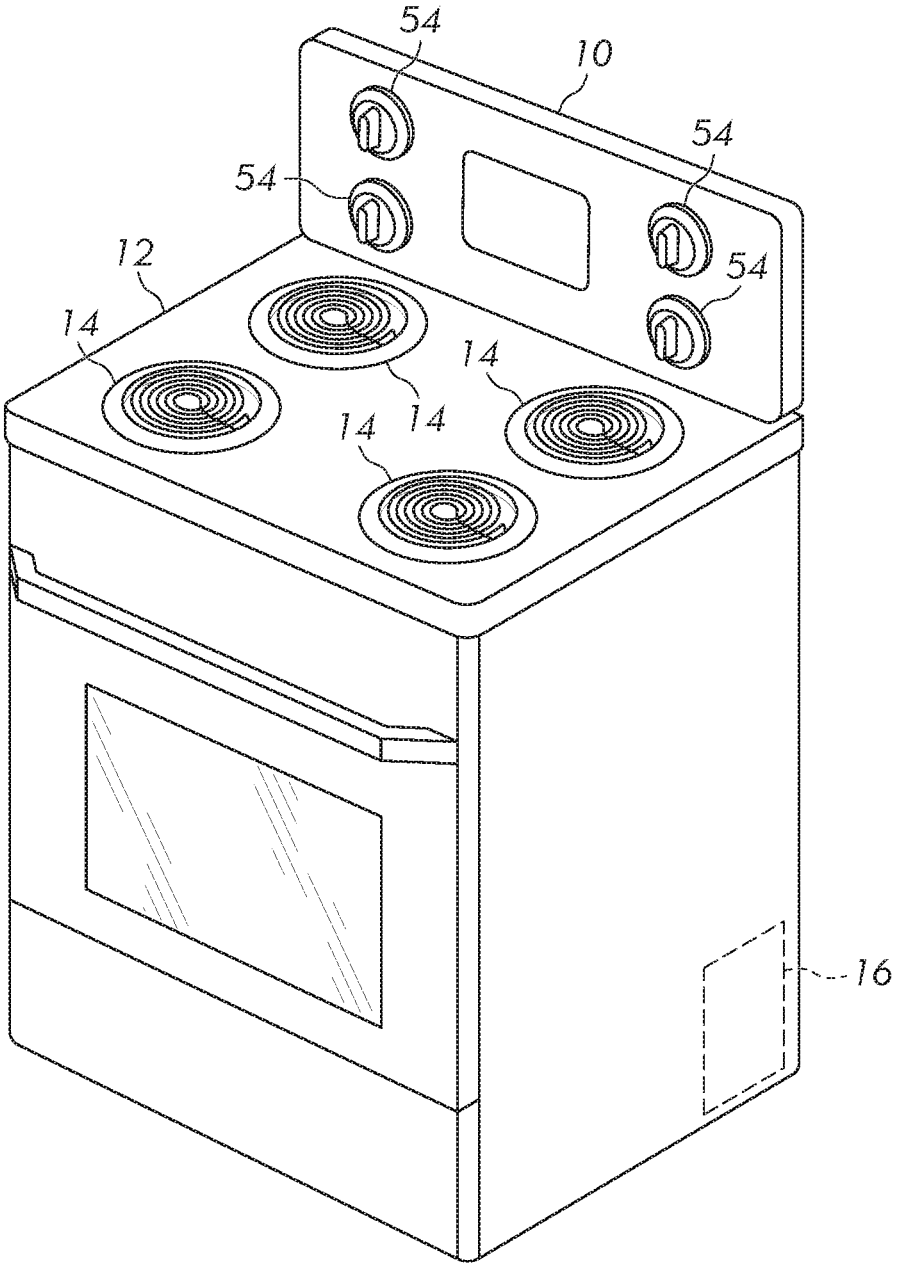
FIG. 1 is a perspective view of an example cooking appliance.

An example cooking appliance 10 is shown in FIG. 1 that includes a housing 12, at least one heating element 14, and a power source 16. The power source 16 is configured for supplying power (e.g., electrical current) to each heating element 14 to generate heat. Each heating element 14 can be any element configured to receive power for heating foodstuff within or on a cooking vessel (not shown) by conduction, convection, radiation, induction, or some combination thereof. The cooking vessel can be a pot, a pan, a skillet, or any other cooking apparatus or utensil that can be used to support or contain foodstuff to transfer heat generated by the heating element 14 to the foodstuff. It is to be appreciated that the foodstuff can be a solid, a liquid, or any other type of substance used in cooking. In embodiments of particular interest, the foodstuff will include or will be combined with a cooking oil or food oil for cooking in the cookware member.

Each heating element 14 can be adjustable between a working-power level wherein the heating element 14 is energized to generate heat, and a zero-power level wherein the heating element 14 is not energized to generate heat. For the purposes of this disclosure, a heating element is "energized" when power is being either 1) persistently applied to the heating element to persistently generate heat, or 2) periodically applied to the heating element according to a predetermined mode of operation to periodically generate heat. Moreover, a heating element is "not energized" when power is persistently not being applied to the heating element and an intervening, non-automatic, event will be required to apply power to and energize the heating element.

Each heating element 14 can include an electric resistance element 18 that a current can be provided through to generate heat for transfer to its associated cooking vessel and any foodstuff contained within. Each heating element 14 is adjustable between a working-power level wherein the electric resistance element 18 is energized, and a zero-power level wherein the electric resistance element 18 is not energized. At the working-power level, current can be persistently applied to the electric resistance element 18, thereby persistently generating heat and causing the electric resistance element 18 to increase in temperature until eventually, the electric resistance element 18 reaches a maximum temperature of, for example, 700° C. Alternatively, current can be periodically applied to the electric resistance element 18 according to a predetermined mode of operation to periodically generate heat so that the operating temperature of the electric resistance element 18 is maintained about a lower temperature of, for example, 400° C. or greater. For example, current can be periodically applied according to a program set by a controller or the current can be periodically applied according to a bimetal switch that is designed to open and close in a predetermined manner to periodically apply current to the electric resistance element 18. At the zero-power level, current is persistently not applied to the electric resistance element 18 such that heat is not generated by the heating element 14 and an intervening, non-automatic, event such as, for example, user adjustment of the heating element 14 will be required to apply power to and energize the heating element 14. It is to be noted that when each heating element 14 is adjusted to its zero-power level, although the heating element 14 will not generate heat, it may still release heat from thermal energy still stored in the element from when it was energized.

In still other examples, the heating elements 14 can include an induction coil that a current can be provided through to induce the generation of heat in the cooking vessel itself. Each heating element 14 can be adjustable between a working-power level wherein the current is persistently or periodically provided through its induction coil to persistently or periodically generate heat in the cooking vessel, and a zero-power level wherein current is persistently not provided through the induction coil. The heating elements 14 can include any element that is adjustable between a working-power level wherein the heating element 14 is energized such that it persistently or periodically generates heat, and a zero-power level wherein the heating element 14 is not energized to generate heat.

A control knob 54 is associated with each heating element 14 for allowing a user to control the power supplied to the respective heating element 14. For example, by turning its associated control knob 54, the period of current to a heating element 14 can be adjusted.

Figure 2:
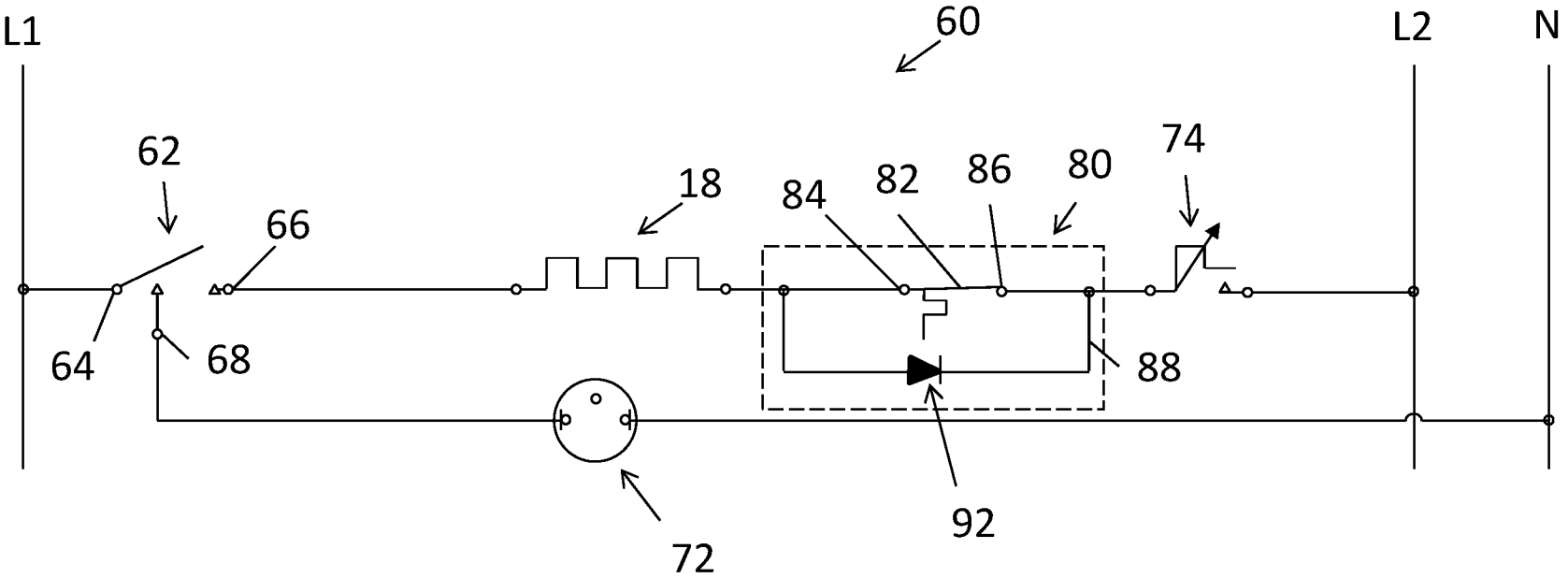
FIG. 2 shows a schematic diagram of a first power circuit for a heating element of the cooking appliance shown in FIG. 1.

As shown in FIG. 2, the electric resistance element 18 is part of a first power circuit 60. The first power circuit 60 is configured to control power from a three-phase power supply, which has a conductor N and phase conductors L1, L2. The third phase conductor, which is normally used for an oven, is not shown in the present application.

It is contemplated that a voltage of 120V may be present between the conductor N and the phase conductor L1, as well as between the conductor N and the phase conductor L2. The line voltage of 240V may be present between the phase conductors L1 and L2.

The first power circuit 60 includes a main power switch 62, a power indicator 72, a control switch 74 and a thermal switch assembly 80.

The main power switch 62 includes a first contact 64 that is connected to the phase conductor L1, a second contact 66 that is connected to the phase conductor L2 and a third contact 68 that is connected to the conductor N. The main power switch 62 is configured to move between a closed position wherein the first contact 64 and the second contact 66 are electrically connected and an open position wherein the first contact 64 and the second contact 66 are electrically disconnected. When the main power switch 62 is in the closed position, the phase conductor L1 is connected to the conductor N through the power indicator 72. It is contemplated that the power indicator 72 may be a light that is illuminated when current flows there through. When the main power switch 62 is in the closed position the phase conductor L1 is also connected to the phase conductor L2 to allow 240V to be applied to the first power circuit 60.

When the main power switch 62 is closed, power will be supplied to the electric resistance element 18 thereby causing the operating temperature of the heating element 14 to rise. (For the purposes of this disclosure, reference to the "operating temperature" of a heating element 14 can mean the temperature of the heating element 14 itself or the temperature of a target item heated by the heating element 14 such as, for example, a cooking vessel disposed on or adjacent the heating element 14). If the main power switch 62 is later opened, the supply of power to the electric resistance element 18 will cease, thereby causing the operating temperature of the heating element 14 to fall.

If the main power switch 62 is closed and power is supplied persistently for a sufficient amount of time, the operating temperature of the heating element 14 will eventually reach a maximum-operable-temperature of, for example, 700° C. or greater. (For the purposes of this disclosure, reference to the "maximum-operable-temperature" of a heating element 14 means the operating temperature of the heating element 14 during a steady state in which continued supply of power to the heating element 14 from an associated power source will no longer increase the operating temperature).

The control switch 74 is provided to allow a user to control the power from the phase conductors L1, L2 that is applied to the electric resistance element 18. Each control switch 74 is controlled by a respective control knob 54 of the cooking appliance 10. The control knob 54 may be coupled to the control switch 74 such that rotation of the control knob 54 allows a user to select a temperature and/or mode of operation for the electric resistance element 18. The control switch 74 may be a conventional infinite switch wherein rotation of the control knob 54 controls a duty cycle of the switching of contacts of the control switch 74. The infinite switch may include a bimetal element that opens the contacts of the control switch 74 when the bimetal element senses a temperature that is at or above a predetermined temperature. When the bimetal element senses a temperature that is below the foregoing predetermined temperature, the bimetal element will maintain the contacts closed. The cycling of the contacts controls the cycling of power to the electric resistance element 18 thereby controlling the temperature of the electric resistance element 18. An exemplary control switch is described in more detail in U.S. Patent Application Publication No. 2017/0089589 to Lamasanu et al. (filed Sep. 13, 2016) hereby incorporated herein by reference.

It may be desirable to maintain the heating element 14 at an operating temperature below its maximum-operable-temperature. For instance, it has been found that foodstuff such as oils can auto-ignite at certain temperatures such as, for example, 424° C. for canola oil, 406° C. for vegetable oil, and 435° C. for olive oil. Thus, it may be desirable to maintain the heating element 14 at an operating temperature that is equal to or less than the auto-ignition temperature of a foodstuff, in order to ensure that a cookware heated by that element or that foodstuffs inside that cookware do not exceed the auto-ignition temperature.

The thermal switch assembly 80 can be designed to open when its temperature is equal to a cut-off temperature. The cut-off temperature is selected so that the thermal switch assembly 80 will open when the operating temperature of the heating element 14 is equal to or above the auto-ignition temperature of a foodstuff, thereby interrupting power to the electric resistance element 18 to maintain its operating temperature below the aforementioned auto-ignition temperature. Thus, the thermal switch assembly 80 can prevent fires that result from the auto-ignition of foodstuff by limiting the maximum operating temperature of the heating element 14 to a predetermined maximum temperature of, for example, 406° C. However, the predetermined maximum temperature can be any predetermined temperature above or below 406° C. in some examples.

The thermal switch assembly 80 may include a conventional thermal cutoff switch wherein a bimetal element 82 electrically connects a first contact 84 and a second contact 86 when a temperature of the bimetal element 82 is below the predetermined cut-off temperature. The bimetal element 82 electrically disconnects the first contact 84 and the second contact 86 when the bimetal element 82 is at or above the predetermined cut-off temperature. The cut-off temperature of the bimetal element 82 is based on the position of the bimetal element 82 relative to the electric resistive element 18. It is contemplated that the bimetal element 82 may be in direct contact with the electric resistive element 18 to detect the actual temperature of the electric resistive element 18 or the bimetal element 82 may be in contact with another component that allows the bimetal element 82 to detect another temperature that is representative of the temperature of the electric resistive element 18. For example, the bimetal element 82 may be in contact with a cookware resting on or near the resistive element 18. Alternatively, it may simply be located in the vicinity of the resistive element 18, wherein it will receive thermal energy via radiation from the element 18.

Conventional thermal cutoff switches open when the predetermined cut-off temperature is reached. In this open condition, no power is supplied to a heating element. However, completely shutting off power to the heating element may negatively affect certain cooking operations and cooking performance, particularly when auto-ignition has not actually occurred. For example, the time required to boil water in a cooking vessel will be considerably longer if the power to the heating element 14 is repeatedly shut off when the heating element is at 400° C.

Figure 3:
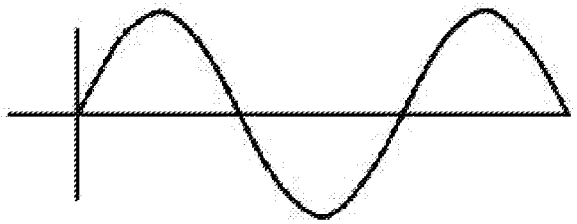
FIG. 3 is a voltage waveform diagram illustrating a full wave power applied to the heating element of FIG. 1.

In the illustrated embodiment the thermal switch assembly 80 includes a diode 92 bypass, which results in partially reducing power to the electric resistive element 18 when the bimetal element 82 is displaced so that it disconnects contact 84 from contact 86 at its predetermined cut-off temperature. As shown in FIG. 2, the diode 92 is placed in a parallel bypass 88 around the bimetal element 82. Prior to the bimetal element 82 reaching the predetermined cut-off temperature, the voltage supplied to the electric resistive element 18 is the normal full wave power supplied between the phase conductors L1, L2, as shown in FIG. 3. This full wave power is applied to the electric resistive element 18 until the bimetal element 82 reaches the predetermined cut-off temperature at which time the bimetal element 82 will be deflected, thereby electrically disconnecting the first contact 84 and the second contact 86.

Figure 4:
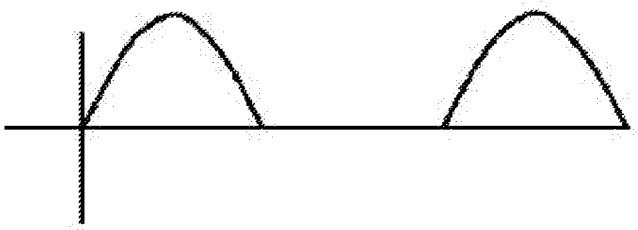
FIG. 4 is a voltage waveform diagram illustrating a half wave power applied to the heating element of FIG. 1.

When the first contact 84 and the second contact 86 are disconnected current is directed through the parallel bypass 88 and the diode 92. The diode 92 rectifies the current between L1 and L2, thereby permitting only a half-waveform power to flow to the electric resistive element 18, as shown in FIG. 4. In the illustrated embodiment, as the voltage between the two phase conductors L1, L2 goes negative, the diode 92 operates to block current flow from phase conductor L1 to the other phase conductor L2, resulting in the half-waveform power being applied to the electric resistive element 18. In an exemplary embodiment wherein the voltage between the phase conductors L1, L2 is 240V, the diode 92 allows only 120V to be applied to the electric resistive element 18. As such, the heating element 14 is able to continue heating the foodstuff in the cooking vessel at half power. The electric resistive element 18 continues to be powered at half-waveform power until the bimetal element 82 cools sufficiently to be restored to its closed configuration wherein it electrically connects the first contact 84 to the second contact 86, thus restoring the full 240V power waveform as seen in FIG. 3.

Figure 5:
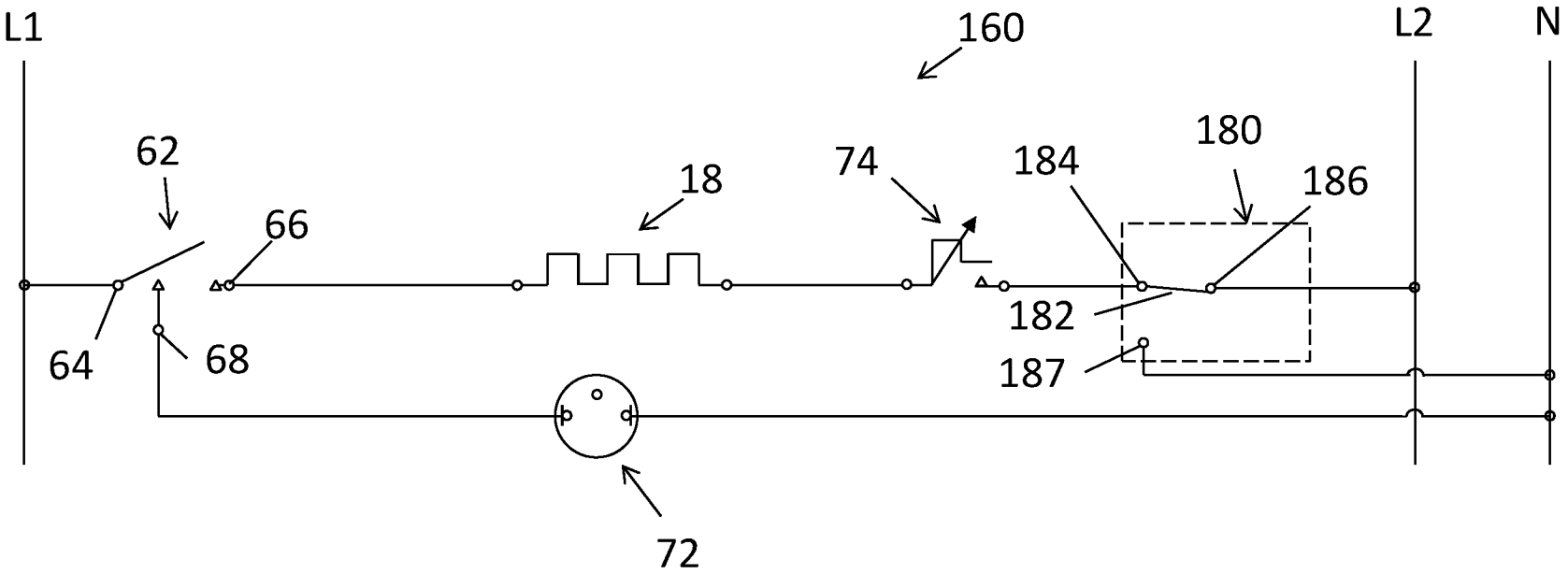
FIG. 5 shows a schematic diagram of a second power circuit for a heating element of the cooking appliance shown in FIG. 1.

FIG. 5 illustrates a second power circuit 160. The components of the second power circuit 160 that are similar to the components of the first power circuit 60 are identified with the same reference number and are not described in detail below, the operation of these components being essentially identical to the operation described above for the first power circuit 60.

The second power circuit 160 replaces the thermal switch assembly 80 with a second thermal switch assembly 180. The second thermal switch assembly 180 includes a bimetal element 182 that is configured to establish an electrical connection between a common contact 184 and either of contacts 186 and 187 as shown. When the bimetal element 182 is below the predetermined cut-off temperature the bimetal element 182 will connect the common contact 184 to the contact 186 thereby forming an electrical path between L1 and L2 that will apply a predetermined maximum voltage, e.g., 240 V AC across the electric resistive element 18. As this power is applied the electric resistive element 18 will rise in temperature which in turn will cause the temperature of the bimetal element 182 to rise. The electric resistive element 18 and the bimetal element 182 will continue their temperature rise until the bimetal element 182 is at the cut-off temperature corresponding to the electric resistive element 18 being at a predetermined maximum temperature, e.g., 400° C. or greater. At that point the bimetal element 182 will be deflected to electrically connect the common contact 184 to the contact 187, thereby forming an electrical path between L1 and N that will apply half the predetermined maximum voltage, e.g., 120 V AC across the electric resistive element 18.

Thus, power to the electric resistive element 18 will be reduced partially, for example by 50%, allowing the electric resistive element 18 to cool below the predetermined maximum temperature while still supplying some power to continue a cooking operation. In an exemplary embodiment, a reduction of 50% power may be achieved by making the conductor N a neutral conductor. It is also contemplated that power reductions other than 50% are possible by applying a different, non-zero voltage to conductor N.

The bimetal element 182 will maintain the common contact 184 electrically connected to the contact 186 until the bimetal element 182 cools to a temperature at or below the temperature corresponding to the electric resistive element 18 being at or below a predetermined temperature, e.g., 350° C. At that point the bimetal element 182 will connect the common contact 184 to the contact 186 so that full power will be restored to the electric resistive element 18.

The invention has been described with reference to example embodiments described above. Modifications and alterations will occur to others upon a reading and understanding of this specification. Example embodiments incorporating one or more aspects described above are intended to include all such modifications and alterations insofar as they come within the scope of the appended claims.

What is claimed is:

1. A power circuit for a cooking appliance, the power circuit comprising:

an electric heating element; and a thermal switch assembly in series with the electric heating element, the thermal switch assembly including:

a first contact connected to the electric heating element, a second contact, and a bimetal element configured to electrically connect and disconnect the first and second contacts, the bimetal element establishing an electrical connection between the first contact and the second contact when a temperature of the bimetal element, as influenced by the electric heating element, is below a predetermined cut-off temperature, and the bimetal element no longer electrically connecting the first contact and the second contact when the temperature of the bimetal element, as influenced by the electric heating element, is at or above the predetermined cut-off temperature, and a first voltage being applied to the electric heating element when the bimetal element electrically connects the first contact and the second contact and a second voltage, lower than the first voltage, is applied to the electric heating element when the bimetal element electrically disconnects the first contact and the second contact, wherein the bimetal element is connected in series with the electric heating element.

2. The power circuit according to claim 1, the predetermined cut-off temperature corresponding to the electric heating element being less than or equal to about 400° C.

3. The power circuit according to claim 1, the predetermined cut-off temperature corresponding to the electric heating element being less than a maximum-operable-temperature of the heating element.

4. The power circuit according to claim 1, the thermal switch assembly further comprising:

a diode connected to the first contact and the second contact via a bypass around the bimetal element effective to supply half-waveform power to the electric heating element when the bimetal element no longer electrically connects the first contact and the second contact.

5. The power circuit according to claim 1, the second contact being connected to a phase conductor at a first voltage, the thermal switch assembly further comprising:

a third contact connected to a conductor at a second voltage lower than the first voltage, the bimetal element electrically connecting the first contact to the third contact when the bimetal element, as influenced by the electric heating element, is at or above the predetermined cut-off temperature, to thereby apply the second voltage to the electric heating element.

6. A power circuit for controlling power to a heating element of a cooking appliance, the power circuit comprising:

an electric heating element; and a thermal switch assembly in series with the electric heating element, the thermal switch assembly including:

a first contact connected to the electric heating element, a second contact, a bimetal element configured to electrically connect and disconnect the first and second contacts based on a temperature of the bimetal element, a bypass connected to the first contact and the second contact for bypassing the bimetal element, and a diode disposed in the bypass, the bimetal element establishing an electrical connection between the first contact and the second contact when a temperature of the bimetal element is below a predetermined cut-off temperature, and the bimetal element no longer electrically connecting the first contact and the second contact when the bimetal element is at or above the predetermined cut-off temperature.

7. The power circuit according to claim 6, the predetermined cut-off temperature corresponding to the electric heating element being less than or equal to about 400° C.

8. The power circuit according to claim 6, the predetermined cut-off temperature corresponding to the electric heating element being less than a maximum-operable-temperature of the heating element.

9. A power circuit for a cooking appliance, the power circuit comprising:

an electric heating element; and a thermal switch assembly in series with the electric heating element, the thermal switch assembly including:

a first contact connected to the electric heating element, a second contact connected to a phase conductor at a first voltage, a third contact connected to a conductor at a second voltage lower than the first voltage, and a bimetal element configured to alternately connect and disconnect the first contact to and from each of the second contact and the third contact, the bimetal element establishing an electrical connection between the first contact and the second contact when a temperature of the bimetal element is below a predetermined cut-off temperature, and the bimetal element establishing an electrical connection between the first contact and the third contact when the bimetal element is at or above the predetermined cut-off temperature, wherein the bimetal element is connected in series with the electric heating element.

10. The power circuit according to claim 9, the predetermined cut-off temperature corresponding to the electric heating element being less than or equal to about 400° C.

11. The power circuit according to claim 9, the predetermined cut-off temperature corresponding to the electric heating element being less than a maximum-operable-temperature of the heating element.

12. A method for operating an electric heating element of a cooking appliance having a bimetal element in series with the electric heating element, comprising:

supplying a full-waveform power to the heating element when the bimetal element is below a predetermined cut-off temperature, and supplying a half-waveform power when the bimetal element is at or above said predetermined cut-off temperature.

13. The method according to claim 12, the step of supplying the half-waveform power including passing current through a diode connected in parallel with the bimetal element.

14. The method according to claim 12, wherein the half-waveform power is rectified.

* * * * *